US005361942A

United States Patent [19]

Salkeld et al.

[11] Patent Number: 5,361,942

[45] Date of Patent: Nov. 8, 1994

[54] LIQUID DISPENSERS HAVING REMOVABLE COMPONENTS

[75] Inventors: Paul Salkeld, Redditch; Andrew Gibbs, Leamington Spa; Robert Tansley, Stratford-Upon-Avon, all of England

[73] Assignee: Ebac Limited, Durham, United Kingdom

[21] Appl. No.: 96,254

[22] Filed: Jul. 26, 1993

[30] Foreign Application Priority Data

Jul. 17, 1992 [UK] United Kingdom ..... 9215276

[51] Int. Cl.[5] ..... B65D 35/56

[52] U.S. Cl. ..... 222/105; 222/146.1; 222/185; 222/479

[58] Field of Search ..... 222/105, 88, 83.5, 185, 222/129, 129.1, 146.1, 146.6, 132, 479, 481, 108; 141/330, 382, 386, 364, 18; 62/390

[56] References Cited

U.S. PATENT DOCUMENTS 4,332,333 6/1982 Linsey ..... 222/479 X
4,450,987 5/1984 Boettcher et al. ..... 222/105 X
4,557,399 12/1985 Redick, Jr. ..... 222/83.5
4,699,188 10/1987 Baker et al. ..... 141/18
4,958,747 9/1990 Sheets ..... 222/129 X

FOREIGN PATENT DOCUMENTS

WO9003919 4/1990 WIPO .

*Primary Examiner*—Gregory L. Huson
*Attorney, Agent, or Firm*—Ira S. Dorman

[57] ABSTRACT

Apparatus for dispensing liquid from an inverted bottle having a neck through which the liquid is discharged, is provided with a mount 32 having a feed tube 34 to project into the neck of the bottle. The feed tube forms part of a reservoir 152 which incorporates a drainage channel 153 to sealably receive the neck of the bottle with closure of drain valve 144. Water travels from the feed tube 34 to a cold reservoir 160 comprising a flexible bag 163 received within a fixed rigid outer 162. Cooled water leaves the bag 163 to a discharge valve 168. The feed tube 34 may also supply a hot water reservoir (FIG. 3 ) which is also replaceable. To maintain strict hygiene, the manifold 152 and both reservoirs are completely replaced at intervals together with the interconnecting pipework.

14 Claims, 3 Drawing Sheets

LIQUID DISPENSERS HAVING REMOVABLE COMPONENTS

TECHNICAL FIELD OF THE INVENTION

This invention relates to liquid dispensers such as bottled water dispensers.

BACKGROUND

Bottled water dispensers are usually arranged to receive the neck of an inverted bottle filled with clean water. Sometimes, as in U.S. Pat. No. 4,699,188 and WO 90/03919 for example, the bottle is provided with a cap through which a feed tube is inserted to discharge the water from the bottle into one or more reservoirs inside the dispenser. The water may then be heated or cooled in the reservoir, from whence the water can be drawn via a discharge valve.

There is currently a requirement to maintain strict hygiene in water dispensers. In the majority of dispensers, the reservoir is a fixed metal unit which must be sterilised and de-scaled in situ. This is an expensive and time consuming operation, so the process is not carried out as often as might be desirable.

An aim of the present invention may be viewed as being to improve the hygiene of such dispensers.

SUMMARY OF THE INVENTION

The liquid dispensing apparatus of the present invention provides for complete replacement of the feed tube, reservoir and interconnecting conduit means during a maintenance operation. These items will usually be discarded, although they could also be taken away and sterilised for re-use.

The reservoir preferably comprises an inner container (which may be semi-rigid or flexible) removably housed within a fixed outer container which incorporates a heating or cooling element. Thus, the inexpensive inner container can be replaced leaving the more expensive heating or cooling element undisturbed. The inner container preferably comprises a flexible bag and the outer container may be cheaply formed of a heat-insulating expanded plastics. Since the bag conforms closely to the shape of the outer container when filled with liquid, the heating efficiency is increased and the cost of forming the heating or cooling element is reduced, the precise shape of the element being less important.

In order to increase the ease of maintenance still further the conduit means preferably comprises flexible tubing of plastics or rubber (natural or synthetic).

The feed tube is preferably surrounded by a drainage channel arranged to conduct any liquid collected therein to waste. The drainage channel is preferably arranged to sealably receive the neck of said bottle and is further provided with a drain valve which is closed when said bottle is engaged therewith.

BRIEF DESCRIPTION OF THE DRAWINGS

The following description and the accompanying drawings referred to therein are included by way of non-limiting example in order to illustrate how the invention may be put into practice. In the drawings.

DETAILED DESCRIPTION OF THE DRAWINGS

Figure 1:
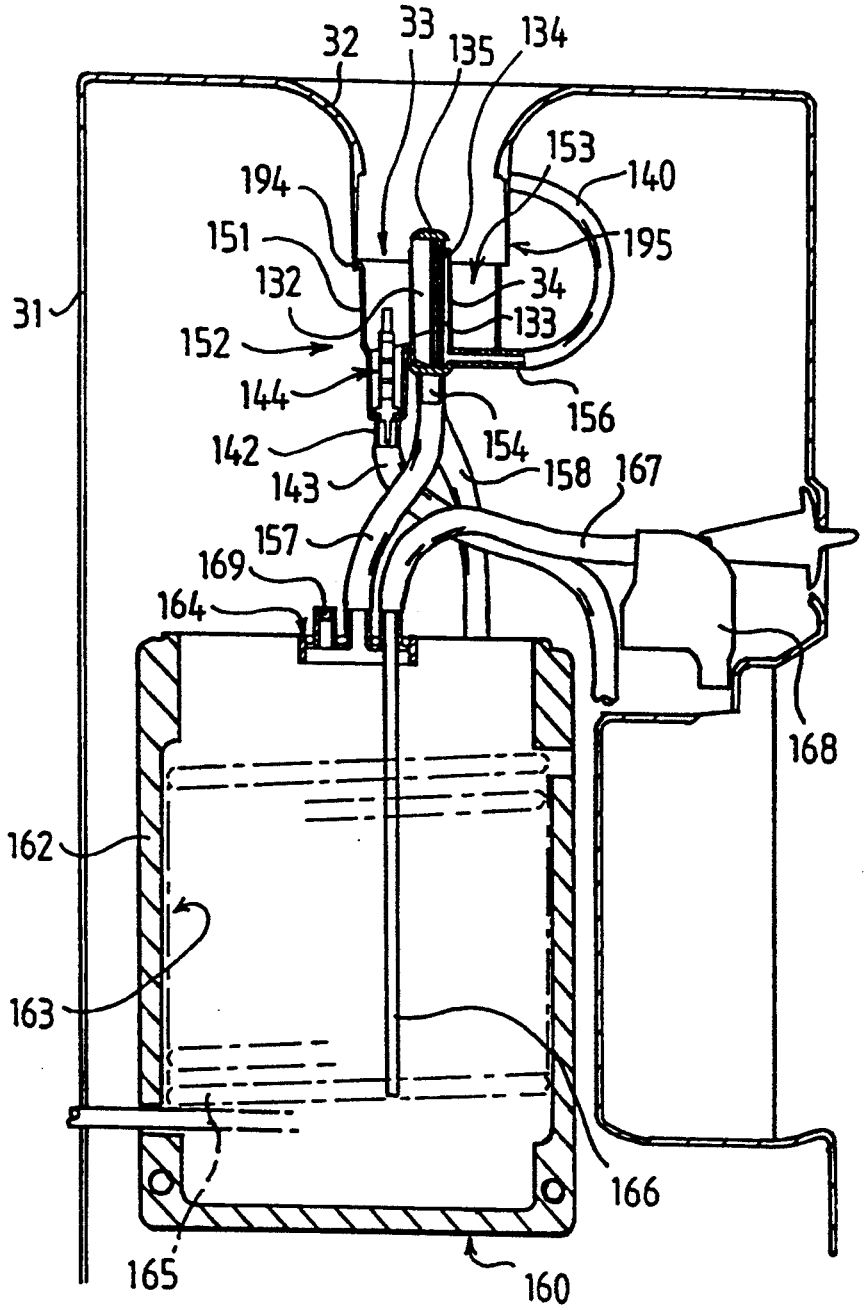
FIG. 1 is a vertical front-rear section through a water dispenser of the invention.

Referring firstly to FIG. 1, the dispenser includes a housing 31 which defines a generally funnel-shaped mounting portion 32 in its top wall for receiving and supporting a conventional inverted water bottle (not shown). The mounting portion 32 leads downwardly to a central circular opening 33 for receiving a capped neck of the bottle, and a feed tube 34 projects axially upwards through the centre of the opening 33, to pass sealably through the cap.

The feed tube 34 forms part of an injection moulded plastics manifold unit 152. The feed tube projects coaxially within an integral outer cup portion 151 to define an annular collecting channel 153. The feed tube 34 is longitudinally divided into two axially extending passages 132 and 133 by an internal dividing wall 134. The dividing wall projects beyond the upper end of the feed tube to support a shield 135 which prevents entry of dirt and debris into the feed tube. Water from the bottle passes into the feed tube and travels along one of the passages 132 to a twinned pair of connecting nipples 154 formed on the bottom of the manifold, only one of which is visible in FIG. 1.

Figure 2:
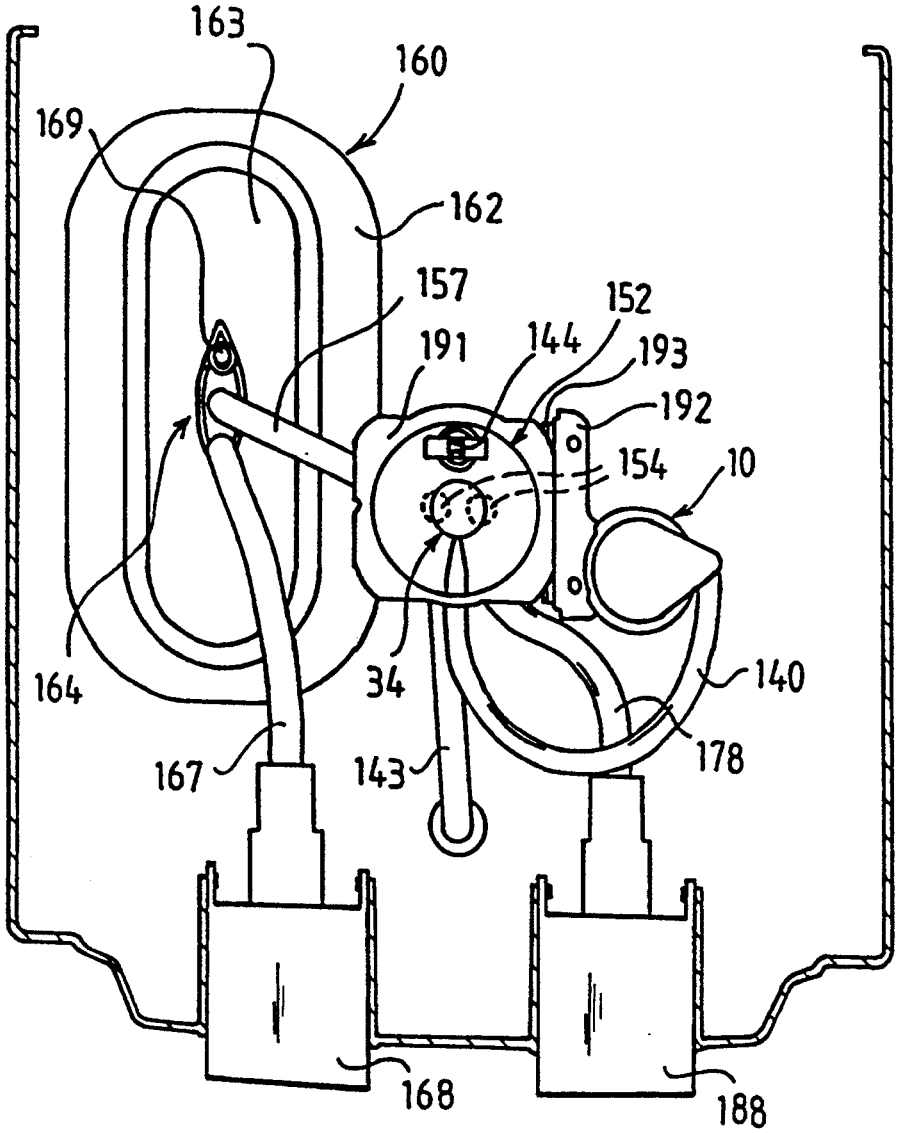
FIG. 2 is horizontal section II—II of FIG. 1 showing part of the dispenser in plan view.

A vent inlet 156 projects radially from the lower end of the feed tube 34 in communication with the second passage 133. Air is taken in through a valve and filter unit 10 (FIG. 2) which removes dirt and bacteria, and includes a one-way check valve to prevent water from escaping through the filter. A blow-out valve may also be incorporated to release any pressure built-up in the water system. Clean air travels from the filter 10 to the vent inlet 156 via a length of flexible plastics or rubber tubing 140, and then travels along the second passage 133 into the bottle to replace discharged water.

The bottom of the cup 151 is provided with a third connecting nipple 142 to couple with a further length of flexible plastics or rubber tubing 143 for conducting any spillage water from the collecting channel 153 to waste. Occasionally the user may fail to seat a new bottle correctly on the feed tube, resulting in a slow leak. In order to prevent a significant proportion of the clean water being lost over a prolonged period, the connecting nipple 142 may incorporate a check valve 144 as shown. The check valve is normally open to conduct spillage to waste, but when the capped neck of the bottle is received within the cup 151 it operates the check valve 144 causing it to close. The side of the cup 151 forms a secondary seal with the neck of the bottle so that once the bottle is engaged water cannot leave the collecting channel 153. When the empty bottle is removed however, the valve 144 reopens to permit drainage of the channel 153.

The manifold is releasably mounted in the housing 31 in any convenient manner. In the illustrated example the upper end of the cup 151 has a generally rectangular external flange 191 (FIG. 2) which slides between a pair of opposed mounting brackets 192 (only one being shown), supported on runners 193 which project inwardly from the mounting brackets. The flange 191 abuts a depending stop 194 (FIG. 1) on the lower end of the funnel portion 32, and a cutout 195 is provided opposite the stop 194 for the feed tube 34 to pass through.

One of the two connecting nipples 154 is connected to a length of flexible plastics or rubber tubing 157 to feed water to a chilled water reservoir assembly 160. An open topped case 162 of expanded polypropylene or other heat-insulation material contains a flexible plastics reservoir bag 163 having a moulded mouth fitting 164 to which the tube 157 is coupled. A cooling coil 165 is recessed into the side wall of the case 162 so that the bag 163 closely conforms to the shape of the coil when filled with water. Water enters the top of the bag from the fitting 164, and an outlet tube 166 projects from the fitting to the bottom of the bag to feed cooled water via a further length of plastics or rubber tubing 167 to a manually operable discharge valve 168. The fitting 164 also has a further connection point 169 which may be blanked off as shown or used to vent the bag to a suitable level.

Figure 3:
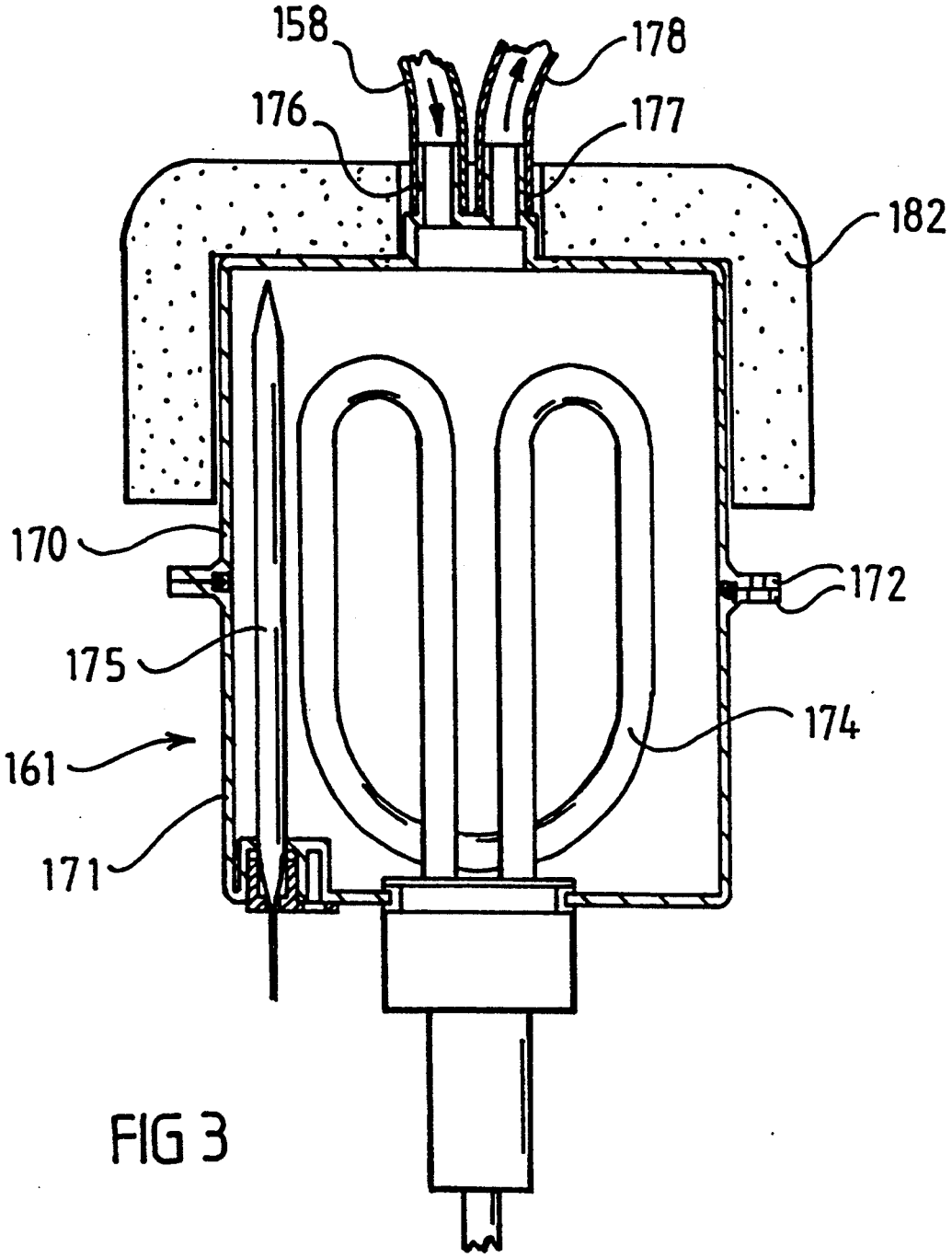
FIG. 3 is a vertical section through a hot water reservoir included in the dispenser.

The second connecting nipple 154 may be blanked off or it may lead via a respective length of flexible plastics or rubber tubing 158 directly to a second discharge valve 188 (FIG. 2) for dispensing water at ambient temperature. The tube 158 may also lead to the valve 188 via a carbonator for example. In the present example, the tubing 158 leads to a hot water reservoir 161, which is shown in FIG. 3. The hot reservoir is formed in two injection moulded parts 170 and 171 which are sealably joined at flanges 172 by suitable releasable fasteners. The reservoir contains a heating element 174 and a temperature probe 175 for thermostatic control of the heating element, both of which are sealably inserted through the bottom of the reservoir. Water from the tube 158 enters a connecting nipple 176 at the top of the reservoir, and hot water leaves via an adjacent nipple 177 to pass via flexible plastics or rubber tubing 178 to the second discharge valve 188. The top of the hot reservoir may also be vented to an appropriate level if required. The upper portion of the reservoir is enclosed within an outer casing 182 of expanded polypropylene or the like, for heat retention.

During maintenance, the manifold unit 152 is removed together with the plastics or rubber tubing and the hot reservoir 161. The bag 163 is also removed from the outer case 162 of the cold reservoir, which remains in situ. The respective items are then replaced by clean ones. Those items which have been removed can either be sterilised for re-use (particularly the hot reservoir 161) or discarded. The discharge valves 168 and 188 are in the form of pinch valves which .operate on the respective tubing 167 and 178. The parts of the dispenser which have direct contact with the water are thus quickly replaced with clean components.

It will be appreciated that the cold reservoir bag 162 could take the form of a semi-rigid disposable container if desired. Also, the hot reservoir 161 could again be formed with a low-cost disposable inner lining (semi-rigid or flexible) which is in intimate heat-exchange contact with an external heating element of a fixed outer casing.

We claim:

1. Liquid dispensing apparatus for dispensing liquid from an inverted container having a neck through which the liquid is discharged, the apparatus comprising:

a housing provided with a mounting arrangement for receiving and supporting an inverted container thereon, said mounting arrangement defining an opening for receiving the container neck;

a dischargeable liquid reservoir releasably mounted within said housing;

a body which includes a feed tube for insertion into the neck of the liquid container to conduct liquid therefrom;

mounting means within said housing for releasably holding said body, said mounting means being arranged to positively support said body within said housing and below said opening such that said feed tube projects upwardly to a level adjacent said opening for being received in the neck of the container, said body being releasably held by said mounting means; and conduit means connected for conducting liquid from said feed tube to said reservoir, said body, conduit means and reservoir thereby being removable for replacement during a maintenance operation.

2. Apparatus according to claim 1, wherein said conduit means comprises a flexible tube.

3. Liquid dispensing apparatus for dispensing liquid from an inverted container having a neck through which the liquid is discharged, the apparatus comprising:

a housing provided with a mounting arrangement for receiving and supporting an inverted container thereon;

a dischargeable liquid reservoir mounted within said housing;

an outer container fixed within said housing, within which said reservoir is closely but removably received, said outer container including a heating or cooling element;

a feed tube;

support means removably supporting said feed tube within said housing beneath said mounting means and disposing said feed tube to project into the neck of the liquid container to conduct liquid therefrom; and conduit means connected for conducting liquid from said feed tube to said reservoir.

4. Apparatus according to claim 3, wherein said reservoir comprises a flexible bag.

5. Apparatus according to claim 3, wherein said outer container is formed of a heat-insulating expanded plastics.

6. Apparatus according to claim 1, in which said body has at least two liquid outlets which communicate with said feed tube, and wherein said conduit means is connected to one of said liquid outlets.

7. Apparatus according to claim 6, wherein said feed tube includes a pathway for returning air to said container to replace liquid discharged therefrom, and said body includes an air inlet connected to said pathway.

8. Apparatus according to claim 7, wherein said air inlet is connected to an air filter.

9. Apparatus according to claim 1, in which said body includes a drainage channel which surrounds said feed tube to conduct any liquid collected therein to waste.

10. Apparatus according to claim 9, wherein said drainage channel is arranged to sealably receive the neck of said bottle and is further provided with a drain valve which is closed when said bottle is engaged therewith.

11. Apparatus according to claim 1, wherein said manifold is provided with a flange which is slid into said mounting means.

12. Apparatus according to claim 11, wherein said mounting means comprises a pair of spaced runners which support said flange.

13. Apparatus according to claim 6, wherein, said apparatus further includes second conduit means, said second conduit means being connected for conducting liquid from the other of said liquid outlets to a discharge valve.

14. Apparatus according to claim 6, wherein said apparatus further includes third conduit means, said third conduit means being connected for conducting liquid from the other of said liquid outlets to a second dischargeable reservoir.

* * * * *